US006286443B1

(12) United States Patent
Fujinami et al.

(10) Patent No.: US 6,286,443 B1
(45) Date of Patent: Sep. 11, 2001

(54) METHOD FOR TREATING COMBUSTIBLES BY SLAGGING COMBUSTION

(75) Inventors: Shosaku Fujinami; Tetsuhisa Hirose; Takahiro Oshita, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/485,452

(22) PCT Filed: Aug. 11, 1998

(86) PCT No.: PCT/JP98/03572

§ 371 Date: Feb. 10, 2000

§ 102(e) Date: Feb. 10, 2000

(87) PCT Pub. No.: WO99/08047

PCT Pub. Date: Feb. 18, 1999

(30) Foreign Application Priority Data

Aug. 11, 1997 (JP) ..... 9-228876

(51) Int. Cl.[7] ..... F23B 5/00; F23B 1/12; C22B 5/20

(52) U.S. Cl. ..... 110/346; 110/208; 110/210; 110/245; 110/295; 110/345; 110/213; 75/414

(58) Field of Search ..... 110/208, 209, 110/210, 213, 243, 244, 245, 295, 345, 346; 75/694, 695, 658, 659, 414, 10.29, 10.3, 10.31, 10.32

(56) References Cited

U.S. PATENT DOCUMENTS

| | | | | |
|---|---|---|---|---|
| 4,673,431 | * | 6/1987 | Bricmont | 75/25 |
| 4,676,177 | * | 6/1987 | Engstrom | 110/345 |
| 5,309,850 | * | 5/1994 | Downs et al. | 110/235 |
| 5,425,317 | * | 6/1995 | Schaub et al. | 110/346 |
| 5,441,714 | * | 8/1995 | Oakes et al. | 423/235 |
| 5,725,614 | * | 3/1998 | Hirayama et al. | 48/76 |
| 5,858,033 | * | 1/1999 | Hirayama et al. | 48/198.6 |
| 5,906,671 | * | 5/1999 | Weinwurm et al. | 75/479 |
| 6,190,429 | * | 2/2001 | Fujimura et al. | 48/197 R |
| 6,199,492 | * | 3/2001 | Kuntsler | 110/342 |

FOREIGN PATENT DOCUMENTS

| | | | |
|---|---|---|---|
| 0 776 962 | | 6/1997 | (EP) . |
| 9-164803 | | 9/1984 | (JP) . |
| 64-49814 | | 2/1989 | (JP) . |
| 1-129510 | | 9/1989 | (JP) . |
| 5-106826 | * | 4/1993 | (JP) . |
| 9-96406 | * | 4/1997 | (JP) . |
| 9-178131 | | 7/1997 | (JP) . |

* cited by examiner

*Primary Examiner*—Denise L. Ferensic
*Assistant Examiner*—K. B. Rinehard
(74) *Attorney, Agent, or Firm*—Wenderoth, Lind & Ponack, L.L.P.

(57) ABSTRACT

The present invention relates to a method for treating combustibles by slagging combustion, such as municipal wastes, plastic wastes, sewage sludges, or automobile wastes. Combustibles and oxygen-containing gas are supplied to a slagging combustion furnace (3), and the combustibles are partially oxidized under a reducing atmosphere in a primary combustion chamber (8) to obtain combustible gas and convert ash content in the combustibles into molten slag which is discharged from a slag separation chamber (10), and then the combustible gas is completely combusted in a secondary combustion chamber (9) by supplying oxygen-containing gas.

6 Claims, 6 Drawing Sheets

METHOD FOR TREATING COMBUSTIBLES BY SLAGGING COMBUSTION

TECHNICAL FIELD

The present invention relates to a method for treating combustibles by slagging combustion in which combustible wastes such as municipal wastes, refuse-derived fuel, solid-water mixture, plastic wastes, FRP wastes, sewage sludges, biomass wastes, automobile wastes, low-grade coal, or waste oil are combusted by a slagging combustion furnace or a combination of a gasification furnace and a slagging combustion furnace without generating dioxins, and at the same time ash content in the combustible wastes is recovered as glassy slag from which heavy metals are not eluted out.

Among the combustible wastes, the refuse-derived fuel (RDF) is produced by crushing and classifying municipal wastes, adding quicklime to the classified municipal wastes, and compacting them to shape. The solid water mixture (SWM) is produced by crushing municipal wastes, converting them into a slurry by adding water, and converting the slurry under a high pressure into an oily fuel by hydrothermal reaction.

BACKGROUND ART

For reducing a volume of sewage sludges, a technology in which the sludges are dried and then combusted at a high temperature in a slagging combustion furnace has been already put to practical use. Further, a technology in which combustible wastes are combusted without emission of toxic matter by a combination of a gasification furnace and a slagging combustion furnace is about to be put to practical use. The purpose of this gasification and slagging combustion system is to prolong landfill sites by converting ashes into slag, utilize slag which has been converted from ashes to pavement materials or the like, decompose harmful substances such as dioxins completely, and establish a combustion technology which is suitable for environmental conservation, has a simple structure and low plant cost, yet has the above-mentioned functions.

FIG. 6 shows an example of a conventional gasification and slagging combustion system. As shown in FIG. 6, the gasification and slagging combustion system comprises a constant feeder 1, a fluidized-bed gasification furnace 2 and a swirling-type slagging combustion furnace 3. The fluidized-bed gasification furnace 2 has an air chamber 5 at a lower portion thereof and the air chamber 5 has an air diffusion plate 4 at an upper portion thereof. A fluidized-bed 6 of silica sand is formed over the air diffusion plate 4. A freeboard 7 is provided above the fluidized-bed 6 for preventing silica sand from being carried over and suppressing pressure fluctuations. On the other hand, the swirling-type slagging combustion furnace 3 has a primary combustion chamber 8, a secondary combustion chamber 9 and a slag separation chamber 10 therein.

Silica sand is located over the air diffusion plate 4 in the fluidized-bed gasification furnace 2, and air "b" supplied into the air chamber 5 is ejected upwardly from the air diffusion plate 4 to thus form the fluidized-bed 6 of silica sand over the air diffusion plate 4. The silica sand comprises river sand having a diameter of about 0.5 mm.

Combustible wastes "a" supplied into the fluidized-bed gasification furnace 2 by the screw-type constant feeder 1 fall into the fluidized-bed 6 which is kept at a temperature ranging from 450 to 850° C., and are contacted with the heated silica sand and quickly pyrolyzed, thus generating gas, tar and fixed carbon. Then, these pyrolyzed substances are gasified by being contacted with oxygen in air "b". In the meanwhile, the fixed carbon is gradually pulverized by oxidization and a stirring action of the fluidized-bed.

Air "b" is blown into the freeboard 7 of the fluidized-bed gasification furnace 2, if necessary, and hydrocarbon, tar and fixed carbon are partially combusted at a temperature ranging from 650 to 850° C. Large-sized incombustibles "d" are discharged together with silica sand from the bottom of the fluidized-bed gasification furnace 2. The discharged incombustibles "d" contain metals such as iron, copper or aluminum. As the inside of the furnace is in a reducing atmosphere, metals can be recovered in a non-oxidized and clean condition. The discharged incombustibles and silica sand are separated from each other by a separating device (not shown), and the large-sized incombustibles are discharged to the outside of the separating device and the small-sized silica sand is returned to the fluidized-bed gasification furnace 2.

The generated gas "c" discharged together with fixed carbon from the fluidized-bed gasification furnace 2 is supplied to the swirling-type slagging combustion furnace 3, and they are mixed with preheated air "b" in a swirling flow and rapidly combusted at a high temperature ranging from 1200 to 1600° C. in the vertical primary combustion chamber 8, and the secondary combustion chamber 9 inclined slightly with respect to the horizontal. The combustion reaction is completed in the secondary combustion chamber 9. Because of the high temperature combustion, ash content in the fixed carbon is converted into slag mist which is mostly trapped by molten slag phase on an inner wall of the combustion chamber due to the centrifugal forces of the swirling flow. The molten slag "f" flows down on the inner wall and is discharged from the bottom of the slag separation chamber 10. Thereafter, the molten slag "f" is cooled indirectly or directly, and is then discharged as granulated slag to the outside of the furnace.

On the other hand, the exhaust gas "e" discharged from the top of the slag separation chamber 10 passes through a series of heat recovery equipment or dust removing equipment (not shown), and is then discharged to the atmosphere. In this manner, 90% of ash content is discharged as the molten slag "f" and the remaining 10% of ash content is mostly collected as fly ash by a bag filter.

In the conventional system shown in FIG. 6, after the combustion reaction is completed in the secondary combustion chamber, the molten slag is discharged from the furnace, and hence the primary combustion chamber is in a reducing atmosphere and the secondary combustion chamber is in an oxidizing atmosphere. Since slag produced in the secondary combustion chamber is exposed to the oxidizing atmosphere, vaporization of heavy metals having a low boiling point from the slag is not sufficiently performed.

To be more specific, municipal wastes and plastic wastes which are typical combustible wastes contain a trace of heavy metals having a low boiling point, such as Hg, Cd, Pb, Zn, or As, and the inclusion of such heavy metals having a low boiling point into the obtained slag is inevitable in the conventional gasification and slagging combustion system shown in FIG. 6. However, such heavy metals having a low boiling point entrapped in the slag are eluted out in an acid solution, and hence it is impossible to enclose the heavy metals having a low boiling point completely in the slag.

Further, in the complete combustion process in the slagging acombustion furnace, if wastes do not have a lower heating value of 2,000 kcal/kg or more, then auxiliary fuel is required. Therefore, there has been a need for lowering the heating value of wastes capable of being combusted independently. That is, there has been a need for such technology in which the lower limit of the heating value capable of operating the furnace without an auxiliary fuel can be lowered.

It is therefore an object of the present invention to provide a method for treating combustibles by slagging combustion which can obtain harmless molten slag whose content of heavy metals having a low boiling point is reduced to a level as low as possible, and can treat wastes without any auxiliary fuel even if the wastes have a low heating value.

According to a first aspect of the present invention, there is provided a method for treating combustibles by slagging combustion, characterized in that: combustibles and oxygen-containing gas are supplied to a slagging combustion furnace and the combustibles are partially oxidized in a reducing atmosphere to obtain combustible gas and convert ash content into molten slag which is discharged from the slagging combustion furnace; and the combustible gas is completely combusted by supplying oxygen-containing gas.

According to the first aspect of the present invention, since the process from formation of slag by melting ash content in the combustibles to discharge of the slag is carried out in a reducing atmosphere, vaporization of heavy metals having a low boiling point from molten slag into gas is accelerated, the amount of the heavy metals having a low boiling point remaining in the molten slag is reduced to the extremely low level, and harmless slag from which the heavy metals are not eluted out in a landfill site can be obtained. Thereafter, combustible gas obtained by partial oxidization is completely combusted by supplying an excessive amount of air or an excessive amount of oxygen-containing gas. In this manner, the wastes having a low heating value which could not be combusted without any auxiliary fuel in the conventional method can be melted without any supplemental fuel.

It is necessary that an amount of oxygen in the oxygen-containing gas supplied for partial oxidization of the combustibles is in the range of 40 to 100%, preferably 80 to 99% of a theoretical oxygen demand, and an amount of oxygen in the oxygen-containing gas supplied for complete combustion of the combustible gas is in the range of 30 to 90%, preferably 30 to 50% of a theoretical oxygen demand.

In this case, the combustibles comprises gaseous material and/or solid material obtained by partial oxidization of wastes in a gasification furnace by supplying oxygen-containing gas. Thus, even if the wastes are difficult to be pulverized like municipal wastes or plastic wastes, it is possible to treat the wastes by slagging combustion only by preparation of rough shredding of the wastes or the like. The partial oxidization of the wastes is performed in a bed having a temperature raging from 450 to 850° C., preferably 450 to 650° C., more preferably 500 to 600° C. by using a fluidized-bed gasification furnace.

In this case also, a total amount of oxygen in the oxygen-containing gas supplied for partial oxidization of the combustible wastes and partial oxidization of the gaseous material and/or solid material is in the range of 40 to 100%, preferably 80 to 99% of a theoretical oxygen demand, and an amount of oxygen in the oxygen-containing gas supplied for complete combustion of the combustible gas is in the range of 30 to 90%, preferably 30 to 50% of a theoretical oxygen demand.

The slagging combustion furnace comprises a swirling-type slagging combustion furnace. The combustibles supplied to the swirling-type slagging combustion furnace are partially oxidized at a temperature ranging from 1200 to 1600° C., and then the remaining combustible gas is completely combusted at a temperature of 900° C. or higher.

According to a second aspect of the present invention, there is provided a method for treating combustibles by slagging combustion, characterized in that: combustible wastes and oxygen-containing gas are supplied to a gasification furnace and the wastes are partially oxidized to obtain gaseous material and/or solid material; the gaseous material and/or solid material and oxygen-containing gas are supplied to a slagging combustion furnace and the gaseous material and/or solid material are partially oxidized in a reducing atmosphere to obtain combustible gas and convert ash content into molten slag which is discharged from the slagging combustion furnace, and the combustible gas is completely combusted by supplying oxygen-containing gas.

According to the second aspect of the present invention, the wastes are gasified in the gasification furnace to obtain gaseous material and/or solid material, and the process from formation of slag by melting ash content in the gaseous material and/or solid material to discharge of the slag is carried out in a reducing atmosphere. Therefore, vaporization of the heavy metals having a low boiling point from molten slag into gas is accelerated, the amount of the heavy metals having a low boiling point remaining in the molten slag is reduced to the extremely low level, and harmless slag from which the heavy metals are not eluted out in a landfill site can be obtained. Thereafter, combustible gas obtained by partial oxidization is completely combusted by using an excess amount of air or an excess amount of oxygen-containing gas. In this manner, the wastes having a low heating value which could not be combusted without any auxiliary fuel in the conventional method can be burned without any supplement fuel.

In the second aspect also, it is necessary that an amount of oxygen in the oxygen-containing gas supplied for partial oxidization of the combustibles and partial oxidization of the gaseous material and/or solid material is in the range of 40 to 100% of a theoretical oxygen demand, and an amount of oxygen in the oxygen-containing gas supplied for complete combustion of the combustible gas is in the range of 30 to 90% of theoretical oxygen demand.

In the first and second aspects of the present invention, the sum of the oxygen amount in the oxygen-containing gas supplied for partial oxidization and the oxygen amount in the oxygen-containing gas supplied for complete combustion is in the range of 110 to 140%, more preferably 120 to 130% of atheoretical oxygen demand. As a gasification furnace for use in the present invention, a rotary furnace, a fluidized-bed furnace, or a fixed-bed furnace may be used. The fluidized-bed gasification furnace is preferable for treating the wastes because the size range of combustibles which can be used is wide. As a slagging combustion furnace, an entrained-bed furnace may be used, and further swirling-type furnace is preferable for high load combustion.

BEST MODE FOR CARRYING OUT THE INVENTION

Figure 1:
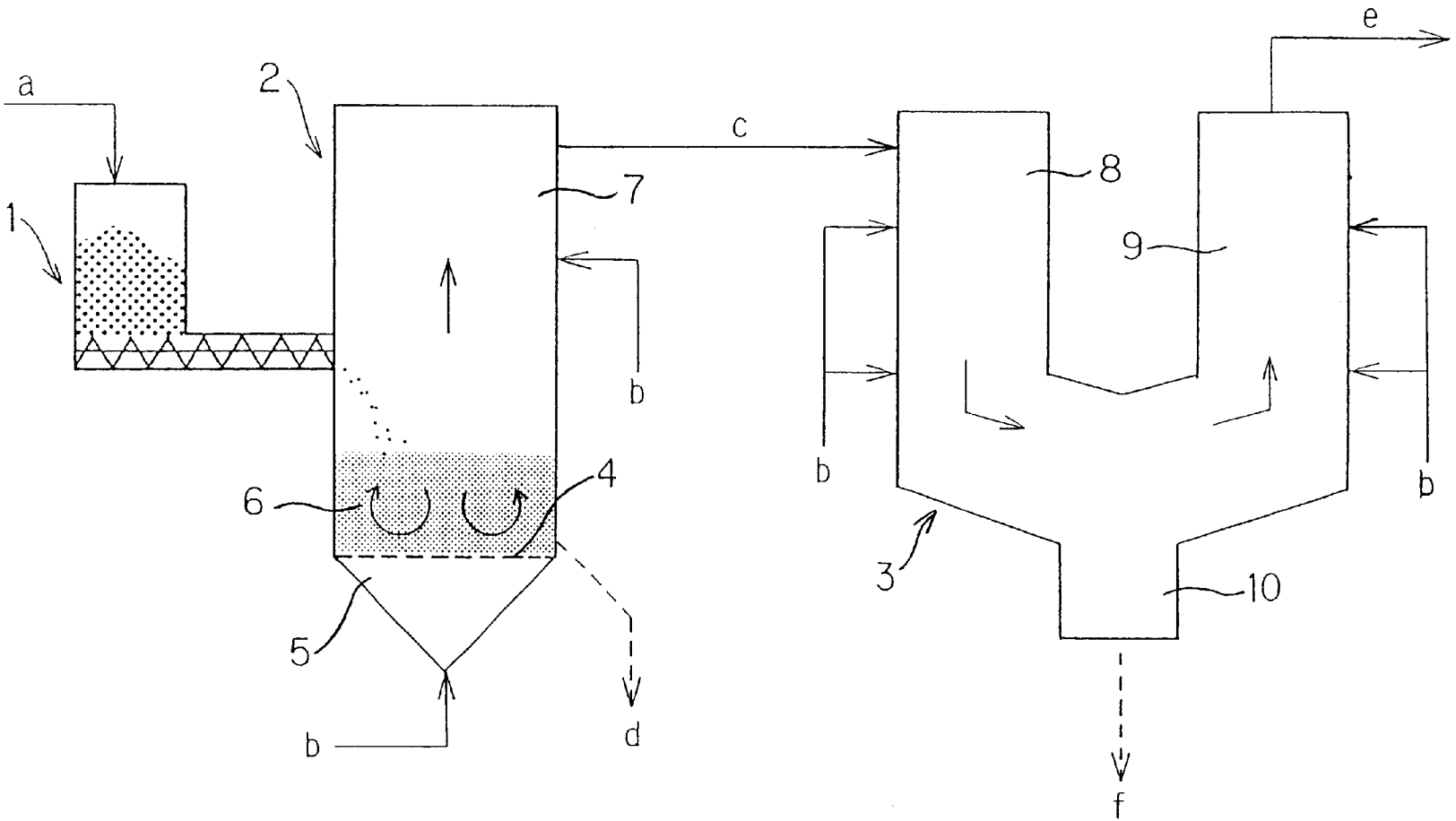
FIG. 1 is a schematic diagram showing an overall structure of a gasification and slagging combustion system according to the present invention.

A gasification and slagging combustion system according to the present invention will be described below with reference to FIGS. 1 through 5. Components in the present invention are designated by the same reference numerals as those shown in the conventional system of FIG. 6.

The system in this embodiment is applied to combustible wastes "a" such as municipal wastes or plastic wastes which are difficult to be pulverized, and hence a fluidized-bed gasification furnace 2 is provided at a preceding stage. The wastes "a" such as municipal wastes supplied from the constant feeder 1 to the fluidized-bed gasification furnace 2 are partially oxidized, i.e. gasified, and gaseous material "c" accompanied by solid material, i.e. pulverized fixed carbon is discharged from the fluidized-bed gasification furnace 2.

The internally-revolving type fluidized-bed gasification furnace 2 is a furnace for which revolving flow of the fluidized medium is positively formed in such a manner that the fluidized medium descends in the central region of the fluidized-bed 6 and ascends in the peripheral region of the fluidized-bed 6. The internally-revolving type fluidized-bed gasification furnace 2 offers the following advantages by keeping the fluidized-bed at a temperature ranging from 450 to 800° C., preferably from 450 to 650° C., and more preferably from 500 to 600° C.

That is, the wastes "a" which have been roughly shredded only can be supplied to the fluidized-bed, and hence the large-sized incombustibles "d" can be smoothly discharged from the fluidized-bed. By keeping the fluidized-bed at a low temperature, the pyrolysis gasification reaction proceeds relatively slowly, and fluctuations in generating gas can be suppressed. Since oxidization of fixed carbon in the fluidized-bed is efficiently carried out, pulverization of fixed carbon and utilization of heat generated by oxidization are efficiently performed. Further, since dispersion of heat in the fluidized-bed is performed well, generation of agglomeration can be prevented, and valuable metals such as iron, copper or aluminum can be recovered in a non-oxidized condition.

If the fluidized-bed is kept at a temperature of 450° C. or lower, then the pyrolysis gasification reaction is extremely sluggish, and undecomposed materials may be deposited in the fluidized-bed. On the other hand, if the fluidized-bed is kept at a temperature of 650° C. or higher, then aluminum cannot be recovered, and since the pyrolysis gasification reaction proceeds rapidly, large fluctuations in producing gas are generated to thus cause a phenomenon, the so-called "disturbance"due to fluctuations in feeding the wastes "a" to the fluidized-bed. If the fluidized-bed is kept at 850° C. or higher, then the possibility of generation of agglomeration increases. Thus, the temperature of the fluidized-bed is in the range of 450 to 850° C., preferably 450 to 650° C., and more preferably 500 to 600° C.

In the case of materials which are particulate or can be easily pulverized like sludges or coal, they are not needed to be partially oxidized in the fluidized-bed gasification furnace 2 and can be supplied directly to the swirling-type slagging combustion furnace 3. In this case, the fluidized-bed gasification furnace 2 can be eliminated from the system shown in FIG. 1 and only the swirling-type slagging combustion furnace 3 is installed in the system. Air is blown into the freeboard 7 of the fluidized-bed gasification furnace 2, if necessary, and the generated gaseous materials are partially oxidized further at a temperature from 100 to 200° C. higher than that in the fluidized-bed.

The generated gas "c" accompanying with pulverized fixed carbon from the fluidized-bed gasification furnace 2 is supplied to the swirling-type slagging combustion furnace 3, and mixed with preheated air "b" in a swirling flow and partially oxidized at a temperature ranging from 1200 to 1600° C., preferably from 1300 to 1400° C. in the vertical primary combustion chamber 8. At this time, because of the high temperature, ash content in the fixed carbon is converted into slag mist which is mostly trapped by molten slag phase on an inner wall of the primary combustion chamber 8 due to the centrifugal forces of the swirling flow. The molten slag "f" flows down on the inner wall and is discharged from the slag separation chamber 10 located between the primary combustion chamber 8 and the secondary combustion chamber 9. Thereafter, the molten slag "f " is cooled indirectly or directly, and is then discharged as granulated slag to the outside of the furnace.

The total amount of oxygen in air supplied to the fluidized-bed gasification furnace 2 and the primary combustion chamber 8 of the swirling-type slagging combustion furnace 3 is in the range of 40 to 100%, preferably 80 to 99% of a theoretical oxygen demand, and thus the portion from the fluidized-bed gasification furnace 2 to the inlet of the secondary combustion chamber 9 via the primary combustion chamber 8 of the swirling-type slagging combustion furnace 3 is kept in a reducing atmosphere.

The amount of oxygen required for partial oxidization in the fluidized-bed gasification furnace 2 and the primary combustion chamber 8 of the swirling-type slagging combustion furnace 3 may be the amount required for raising temperature in the furnace up to a desired slagging combustion temperature while keeping atmosphere therein in a reducing condition.

As the wastes have a high heating value, as the preheated temperature of oxygen-containing gas as a gasifying agent is high, and as the concentration of oxygen in the gasifying agent is high, the required amount of oxygen is low. It is experimentally confirmed that the lower limit of the oxygen amount is about 40% of a theoretical oxygen demand. On the other hand, the upper limit of the oxygen amount is 100% of a theoretical oxygen demand so that the atmosphere is barely kept in a reducing condition. Thus, the amount of oxygen required for partial oxidization is in the range of 40 to 100%, preferably 80 to 99% of a theoretical oxygen demand.

By conducting the process from partial oxidization of the wastes "a" to formation of molten slag by melting ashes in a reducing atmosphere, vaporization of heavy metals having a low boiling point into gas can be accelerated, the remaining amount of heavy metals having a low boiling point in the slag is reduced to the extremely low level, and harmless slag from which the heavy metals are not eluted out at a landfill site can be obtained.

Next, the principle of the above phenomenon will be described below.

The table 1 is quoted from the report (pp. 413–415 in the proceedings of the 7th annual conference of the Japan society of waste management experts) in which the relationship between composition of slag and molten fly ash obtained from various ash melting furnaces and melting conditions is studied.

TABLE 1

| | | | coke-bed | | | high frequency | | arc | | plasma | |
|---|---|---|---|---|---|---|---|---|---|---|---|
| | | | bottom ash | mixed with 15% of fly ash | mixed with 30% of fly ash | mixed with 25% of fly ash | fly ash | surface fly ash | mixed with 30% of fly ash | mixed with 20% of fly ash | fly ash |
| rate for ash into slag (%) | | | 93 | 89 | 87 | 94 | 89 | 81 | 73 | 79 | 77 |
| slag | Pb | concentration (mg/kg) | 71 | 65 | 63 | 5 | 40 | 570 | 110 | 600 | 460 |
| | | rate for ash into slag (%) | 4.3 | 5.7 | 5.6 | 0.3 | 3.4 | 30 | 8.2 | 20 | 14 |
| | | eluted amount (mg/l) | N.D. | N.D. | N.D. | N.D. | N.D. | N.D. | N.D. | N.D. | N.D. |
| | Zn | concentration (mg/kg) | 600 | 930 | 670 | 3500 | 4200 | 3600 | 1400 | 6100 | 11000 |
| | | rate for ash into slag (%) | 20 | 24 | 18 | 19 | 48 | 34 | 18 | 33 | 68 |
| | | eluted amount (mg/l) | — | — | — | — | — | — | N.D. | N.D. | N.D. |
| rate of fly ash (%) | | | 1.4 | 4.5 | 5.6 | 2.0 | 1.3 | 6.5 | 8.6 | 4.5 | 11 |
| composition of fly ash | | Pb (%) | 7.8 | 5.7 | 5.1 | 4.8 | 4.0 | 2.8 | 1.3 | 2.7 | 1.2 |
| | | Zn (%) | 8.6 | 8.3 | 5.6 | 4.5 | 13 | 1.6 | 4.7 | 2.3 | 1.7 |
| | | Cl (%) | 19 | 28 | 25 | 22 | 33 | 28 | 41 | 23 | 32 |
| | | $SiO_2$ (%) | 10 | 3.9 | 5.0 | 0.15 | 0.27 | 2.9 | 2.8 | 2.3 | 1.0 |
| composition of exhaust gas | | $O_2$ (%) | 0.2 | 0.6 | 0.6 | 20 | 20 | 6.0 | 20 | 20 | 20 |
| | | HCl ($O_2$ 12%-ppm) | 8 | 270 | 500 | 520 | 270 | 4200 | 650 | 240 | 550 |
| | | gasification rate of Cl (%) | 2.9 | 2.8 | 5.1 | 2.5 | 3.8 | 44 | 15 | 40 | 54 |
| | | $NO_2$ ($O_2$ 12%-ppm) | 12 | 9 | 8 | N.D. | 21 | 86 | 14 | 1100 | 750 |

From the table 1, strong correlation is found between the remaining amount of Pb and Zn in the slag and the oxygen concentration in the exhaust gas. To be more specific, if the coke-bed type having an oxygen concentration of 0.2 to 0.6% is represented by group A, the high frequency type, the arc type and the plasma type each having an oxygen concentration of 20% are represented as group B, and the surface melting type having an oxygen concentration of 6% is represented as group C, then the concentration of Pb and Zn in the groups B and C having the oxygen concentration of 6 to 20% is several times higher than that in the group A having the oxygen concentration of a value near zero.

This means that vaporization of heavy metals having a low boiling point is accelerated in a reducing atmosphere, and conversely suppressed in an oxidizing atmosphere. Exceptionally, the Pb content in the slag is extremely low in the high frequency type of the group B, though the oxygen concentration is high.

The relationship between vaporization of the heavy metals having a low boiling point and the environmental atmosphere is explained as follows:

That is, in a reducing atmosphere containing no oxygen, Pb and Zn, for example, among the heavy metals having a low boiling point trapped in the slag, when ash content is converted into molten slag, react with Cl or S in the slag, and are convert into metal compounds which are quickly vaporized. Thus, vaporization of Pb and Zn is accelerated. On the contrary, when oxygen is sufficiently contained in the atmosphere, Pb and Zn are rapidly oxidized and converted into PbO and ZnO, and hence vaporization of Pb and Zn is suppressed. That is, vaporization of the heavy metals is accelerated or suppressed, depending on whether the atmosphere is in a reducing condition or an oxidizing condition.

Therefore, if the process from formation of slag by melting to discharge of the slag is carried out in a reducing atmosphere to thus accelerate vaporization of the heavy metals having a low boiling point into gas and reduce the remaining amount of the heavy metals having a low boiling point in the slag, harmless slag from which the heavy metals are not eluted out can be obtained. By acceleration of the heavy metal vaporization into gas, the heavy metals having a low boiling point can be deposited in a high content on the fly ash when the exhaust gas is cooled. Therefore, if the fly ash is collected by a filter-type dust collector such as a bag filter, resource recovery can be performed by a refining process such as extraction of acid component, and material recycling can be realized. It is known that vaporization of the heavy metals having a low boiling point can be accelerated by prolonging a retention time of slag under a high temperature.

In this embodiment, the total amount of oxygen in air supplied to the fluidized-bed gasification furnace 2 and the primary combustion chamber 8 of the swirling-type slagging combustion furnace 3 is in the range of 40 to 100%, preferably 80 to 99% of a theoretical oxygen demand. However, in the case that the wastes "a" are not supplied to the fluidized-bed gasification furnace 2 but are directly supplied to the swirling-type slagging combustion furnace 3, the amount of oxygen in air supplied to the primary combustion chamber 8 of the swirling-type slagging combustion furnace 3 is in the range of 40 to 100%, preferably 80 to 99% of a theoretical oxygen demand.

Combustible gas obtained by partial oxidization in the primary combustion chamber 8 enters the secondary combustion chamber 9 after the slag is discharged, and is mixed with preheated air "b" in a swirling flow and completely combusted at a temperature of 900° C. or higher. At this time, the amount of oxygen in air "b" supplied to the secondary combustion chamber 9 is in the range of 30 to 90%, preferably 30 to 50% of a theoretical oxygen demand, and hence the inside of the secondary combustion chamber 9 is in an oxidizing atmosphere.

In this case, it is necessary only to combust combustible gas in the secondary combustion chamber 9, and since melting of ashes and discharge of slag are completed, the combustion temperature in the secondary combustion chamber 9 is equal to or lower than that in the primary combustion chamber 8. If the durability of refractories is taken into consideration, the combustion temperature in the secondary combustion chamber 9 may be 900° C. or higher, preferably in the range of 900 to 1100° C. so that dioxins and precursor thereof can be decomposed.

In this manner, the total amount of oxygen required for treating combustible wastes may be in the range of 120 to 130% of a theoretical oxygen demand. In the case where the wastes have a low heating value particularly, it is possible to perform slagging combustion of the wastes under a reducing atmosphere by increasing oxygen concentration in the gasifying agent for partial oxidization. Alternatively, auxiliary fuel such as coal having a high heating value may be added to the wastes, or the wastes may be dried.

In the above embodiment of the present invention, it is described that the process from formation of slag mist and adherence of slag mist to the inner wall of the furnace to flowing down and discharge of molten slag from the slagging combustion furnace is performed under a reducing atmosphere. However, the process from formation of slag mist to adherence of slag mist to the inner wall of the furnace may be performed in a reducing atmosphere, and flowing down and discharge of molten slag adhered to the inner wall may be performed in an oxidizing atmosphere. In such way, the effect of the present invention is slightly lowered, but still effective.

The combustion exhaust gas "e" produced in the secondary combustion chamber 9 is discharged from the top of the secondary combustion chamber 9, passes through a series of heat recovery equipment or dust removing equipment (not shown), and is then discharged to the atmosphere. In this manner, about 90% of ash content in the wastes is recovered as molten slag and the remaining about 10% of ash content is mostly collected as fly ash by a bag filter.

In this manner, since the wastes are partially combusted at a high temperature in a reducing atmosphere and molten slag is discharged from the furnace, the slag is discharged while keeping the surrounding of the slag in a reducing atmosphere. Thus, the heavy metals having a low boiling point are sufficiently vaporized from the slag, and harmless slag from which the heavy metals are not eluted out can be recovered.

Figure 2:
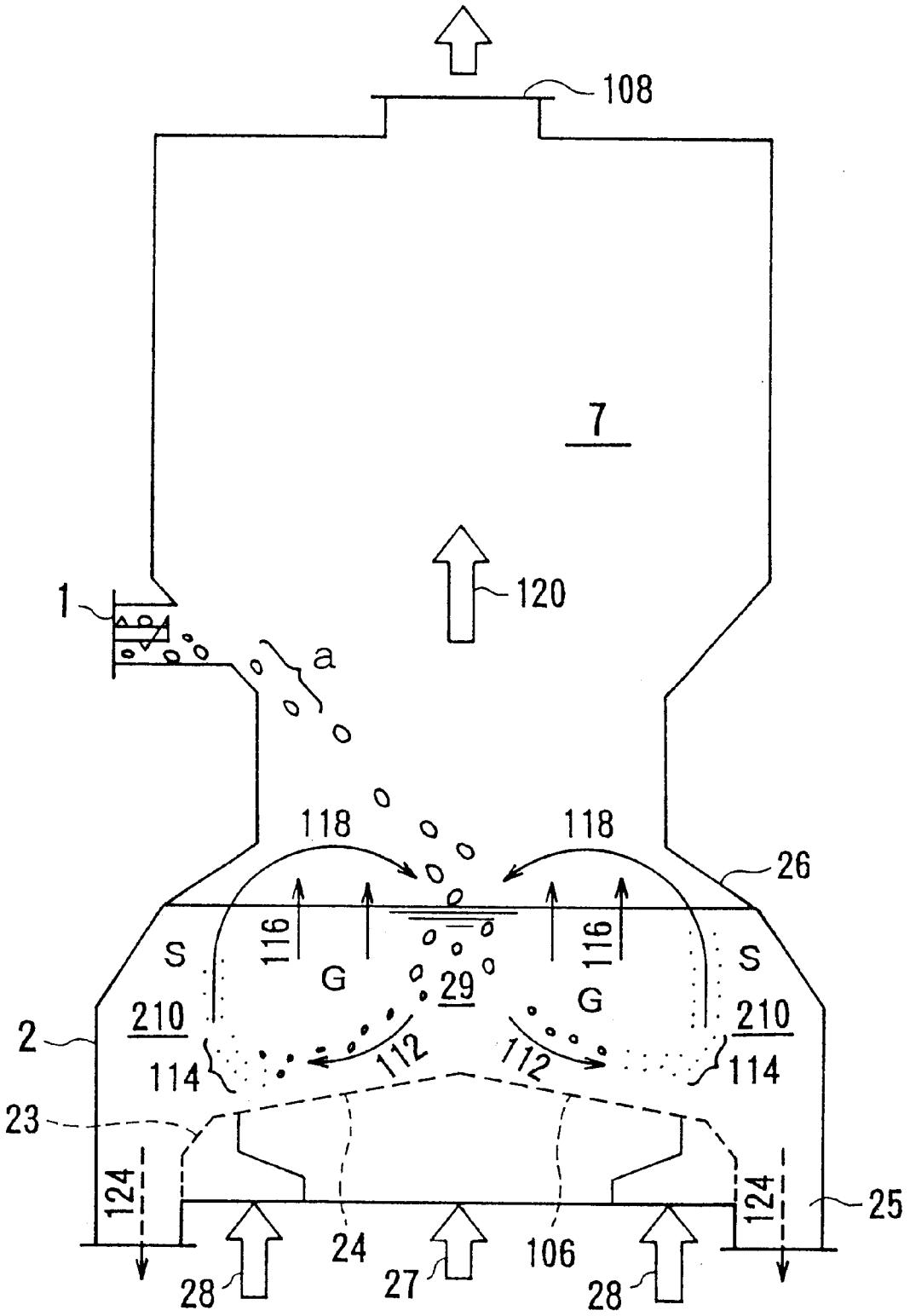
FIG. 2 is a vertical cross-sectional view of a fluidized-bed gasification furnace in one example.
Figure 3:
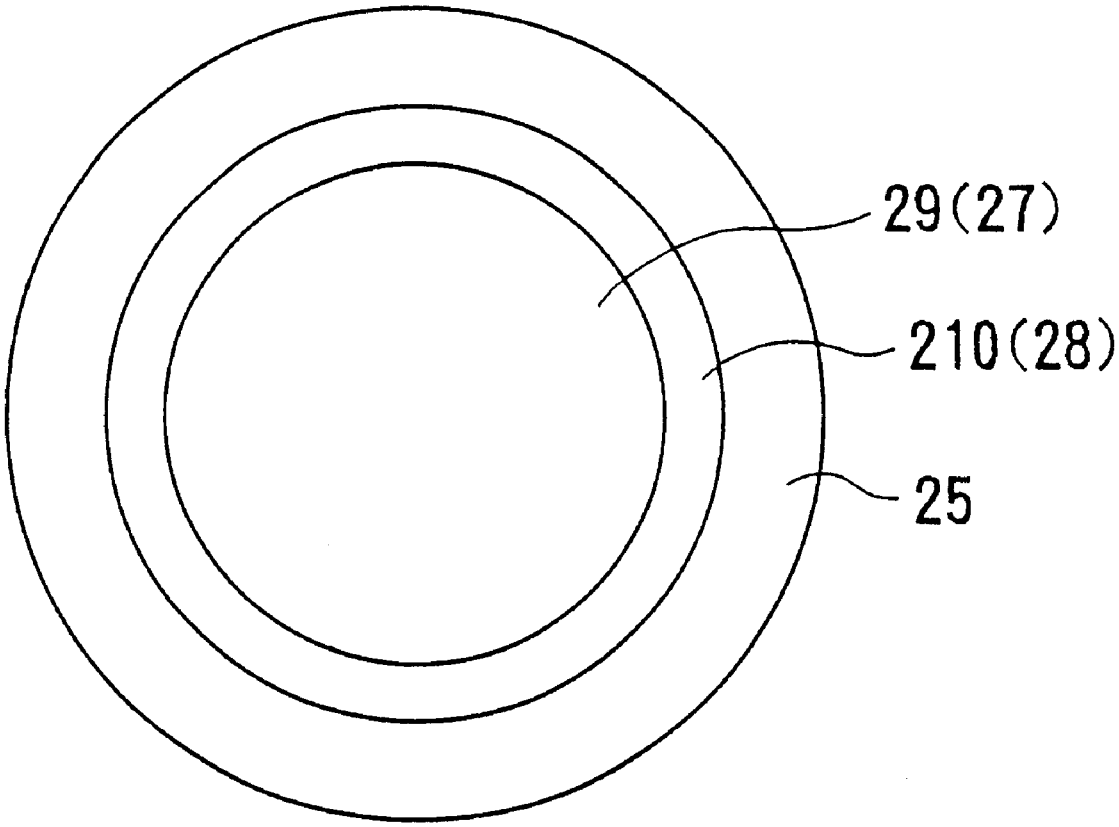
FIG. 3 is a horizontal cross-sectional view of the fluidized-bed gasification furnace shown in FIG. 2.

FIG. 2 is a vertical cross-sectional view of the fluidized-bed gasification furnace 2, and FIG. 3 is a horizontal cross-sectional view of the fluidized-bed in the gasification furnace shown in FIG. 2. In the gasification furnace shown in FIG. 3, fluidizing gases supplied to the fluidized-bed gasification furnace 2 through a fluidizing gas dispersing device 106 disposed in the bottom thereof include a central fluidizing gas 27 supplied as an upward flow into the furnace from a central furnace bottom region 24 and a peripheral fluidizing gas 28 supplied as an upward flow into the furnace from a peripheral furnace bottom region 23.

Each of the central fluidizing gas 27 and the peripheral fluidizing gas 28 is selected from one of three gases, i.e., oxygen, a mixture of oxygen and steam, and steam. The oxygen concentration of the central fluidizing gas is lower than that of the peripheral fluidizing gas.

The mass velocity of the central fluidizing gas 27 is set to be smaller than that of the peripheral fluidizing gas 28. The upward flow of the fluidizing gas in an upper peripheral region of the furnace is deflected toward a central region of the furnace by a deflector 26. Thus, a descending fluidized-bed 29 of the fluidized medium (generally silica sand) is formed in the central region of the furnace, and an ascending fluidized-bed 210 is formed in the peripheral region of the furnace. As indicated by the arrows 118, the fluidized medium ascends in the ascending fluidized-bed 210 in the peripheral region of the furnace, is deflected by the deflector 26 to an upper portion of the descending fluidized-bed 29, and descends in the descending fluidized-bed 29. Then, as indicated by the arrows 112, the fluidized medium moves along the fluidizing gas dispersing device 106 and flows into a lower portion of the ascending fluidized-bed 210. In this manner, the fluidized medium revolves in the ascending fluidized-bed 210 and the descending fluidized-bed 29 as indicated by the arrows 118, 112.

While the wastes "a" supplied to the upper portion of the descending fluidized-bed 29 by the constant feeder 1 descend together with the fluidized medium in the descending fluidized-bed 29, the wastes are gasified by being contacted with oxygen in the fluidizing gas. Because there is no or little oxygen available in the descending fluidized-bed 29, a high calorific gas generated by gasification is slightly combusted and passes through the descending fluidized-bed 29 as indicated by the arrows 116. Consequently, the descending fluidized-bed 29 forms a gasification zone G. The generated gas moves into a freeboard 7 as indicated by the arrow 120.

Fixed carbon produced in the descending fluidized-bed 29 moves together with the fluidized medium from the lower portion of the descending fluidized-bed 29 to the lower portion of the ascending fluidized-bed 210 in the peripheral region of the furnace as indicated by the arrows 112, and is partially oxidized by the peripheral fluidizing gas 28 having a relatively large oxygen concentration. Consequently, the ascending fluidized-bed 210 forms an oxidization zone S. In the ascending fluidized-bed 210, the fluidized medium is heated by the heat produced when the fixed carbon is oxidized. The heated fluidized medium is turned over by the deflector 26 as indicated by the arrows 118, and transferred to the descending fluidized-bed 29 where it serves as a heat source for gasification. In this manner, the fluidized-bed is kept at a temperature ranging from 450 to 850° C.

In the fluidized-bed gasification furnace 2 shown in FIGS. 2 and 3, the gasification zone G and the oxidization zone S are formed in the fluidized-bed, and the fluidized medium circulates in both zones. Therefore, combustible gas having a high heating value is generated in the gasification zone G, and fixed carbon is partially oxidized efficiently in the oxidization zone S. Consequently, the fluidized-bed gasification furnace can gasify wastes effectively In the horizontal cross-sectional view of the fluidized-bed gasification furnace 2 shown in FIG. 3, the descending fluidized-bed 29 which forms the gasification zone G is circular in shape in the central region of the furnace, and the ascending fluidized-bed 210 which forms the oxidization zone S is annular in shape around the descending fluidized-bed 29. The ascending fluidized-bed 210 is surrounded by a ring-shaped incombustible outlet 25.

Figure 4:
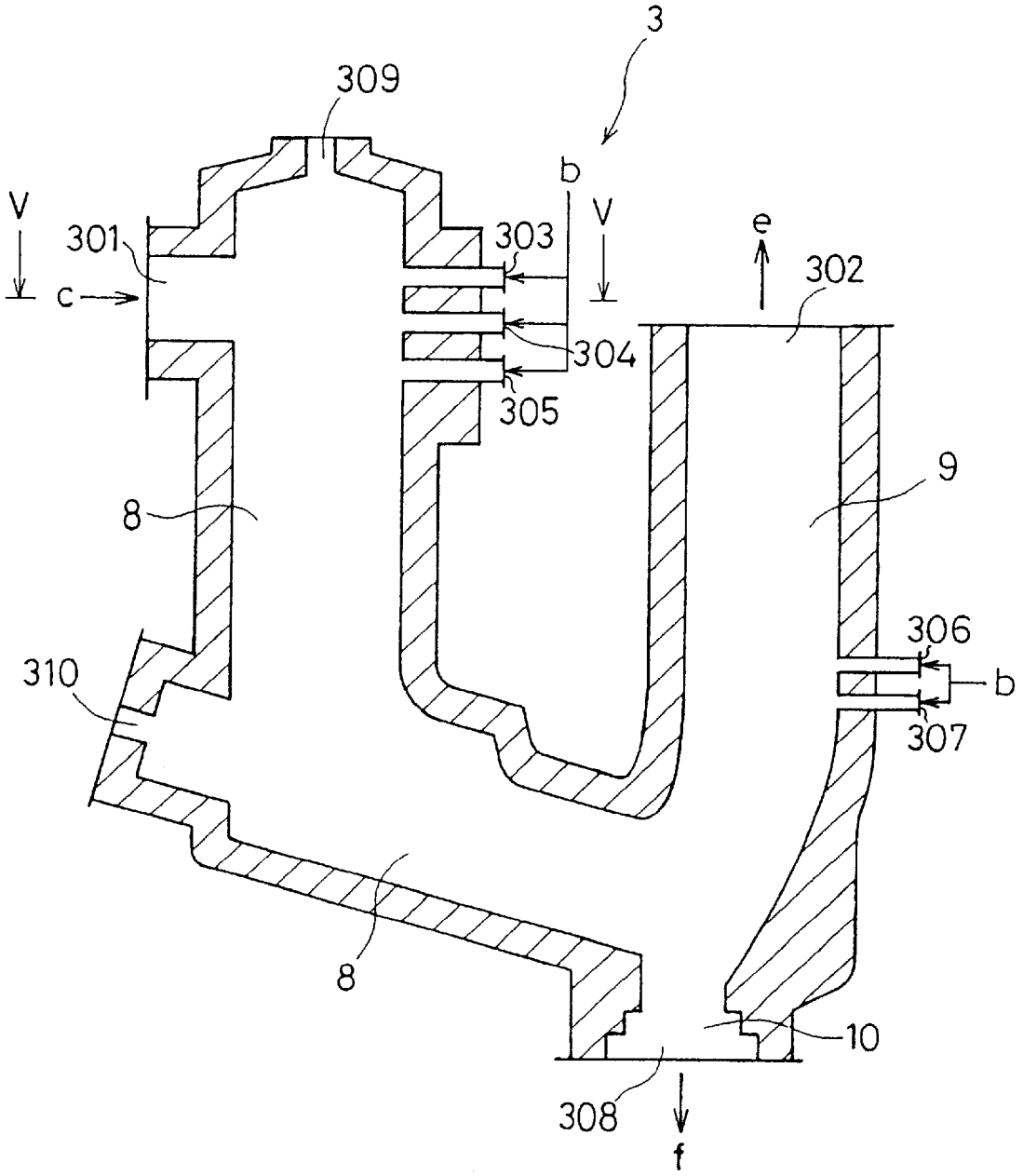
FIG. 4 is a vertical cross-sectional view of a swirling-type slagging combustion furnace according to another embodiment.

FIG. 4 shows a slagging combustion furnace according to another embodiment of the present invention. In FIG. 4, the reference numeral 301 represents a gas inlet, the reference numeral 302 represents a gas outlet, and the reference numerals 303, 304 and 305 each represent an air inlet for primary combustion. The reference numerals 306 and 307 each represent an air inlet for secondary combustion, the reference numeral 308 represents an outlet for molten slag, and the reference numerals 309 and 310 each represent a port for a start-up burner. The produced gas "c" accompanied fixed carbon from the fluidized-bed gasification furnace (not shown) is supplied to the gas inlet 301 provided at the upper portion of the primary combustion chamber 8 of the swirling-type slagging combustion furnace 3, and at the same time the preheated air "b" is supplied to the air inlets 303 to 305 which are located at substantially the same position as the gas inlet 301. Both of the gas "c" and the air "b" are supplied so as to form a swirling flow, and form an intense swirling flow while being mixed with each other, and the gas is combusted at a high temperature ranging from 1200 to 1600° C., preferably 1300 to 1400° C. At this time, the amount of oxygen in the air "b" supplied to the slagging combustion furnace and that in the air supplied to the fluidized-bed gasification furnace is in the range of 40 to 100%, preferably 80 to 99% of a theoretical oxygen demand, and hence the whole area of the primary combustion chamber 8 and the slag separation chamber 10 is kept in a reducing atmosphere in which combustible gas remains. Therefore, since the process from formation of molten slag by slagging combustion to discharge of the molten slag is performed in a reducing atmosphere, vaporization of the heavy metals such as Pb or Zn, i.e. transfer of the heavy metals to gas phase is accelerated. In order to ensure partial oxidization under a reducing atmosphere, collection of slag mist, and retention time required for vaporization of heavy metals from slag into gas, the primary combustion chamber 8 comprises a vertical portion and an inclined portion. This retention time of gas is set to 1 to 2 seconds. The reaction of partial oxidization is completed in the inclined portion and the swirling flow is attenuated therein. The exhaust gas containing combustible gas from which molten slag "f" is discharged at the end of the inclined portion of the primary combustion chamber 8 is introduced to the lower portion of the secondary combustion chamber 9. The preheated air "b" having a high temperature is supplied to the air inlets 306 and 307, and the combustible gas is completely combusted in the secondary combustion chamber 9. At this time, the amount of oxygen in the air "b" supplied thereto is in the range of 30 to 90%, preferably 30 to 50% of a theoretical oxygen demand, and combustion therein is carried out in an oxidizing atmosphere. The combustion in the secondary combustion chamber 9 is performed for complete combustion of the remaining combustible gas, and hence it is not necessary to perform combustion at a high temperature as in the primary combustion chamber 9. Therefore, the combustion is performed at a temperature of 900° C. or higher, preferably in the range of 900 to 1100° C. The obtained exhaust gas "e" accompanying with dust is discharged from the gas outlet 302 provided at the upper portion of the secondary combustion chamber 9, passes through a series of heat recovery equipment or dust removing equipment, and is then discharged to the atmosphere.

Figure 5:
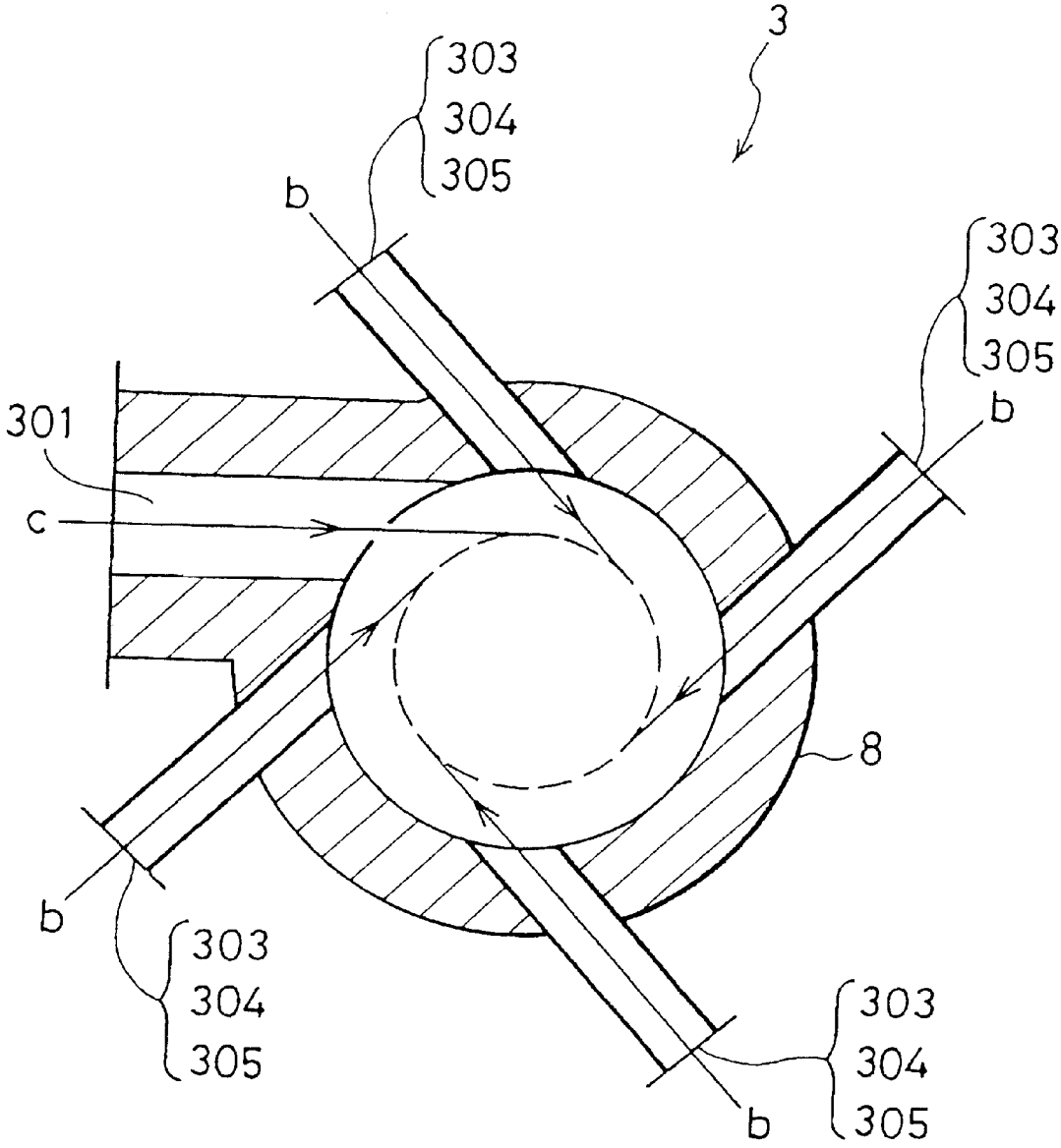
FIG. 5 is a cross-sectional view taken along line V—V of FIG. 4.
Figure 6:
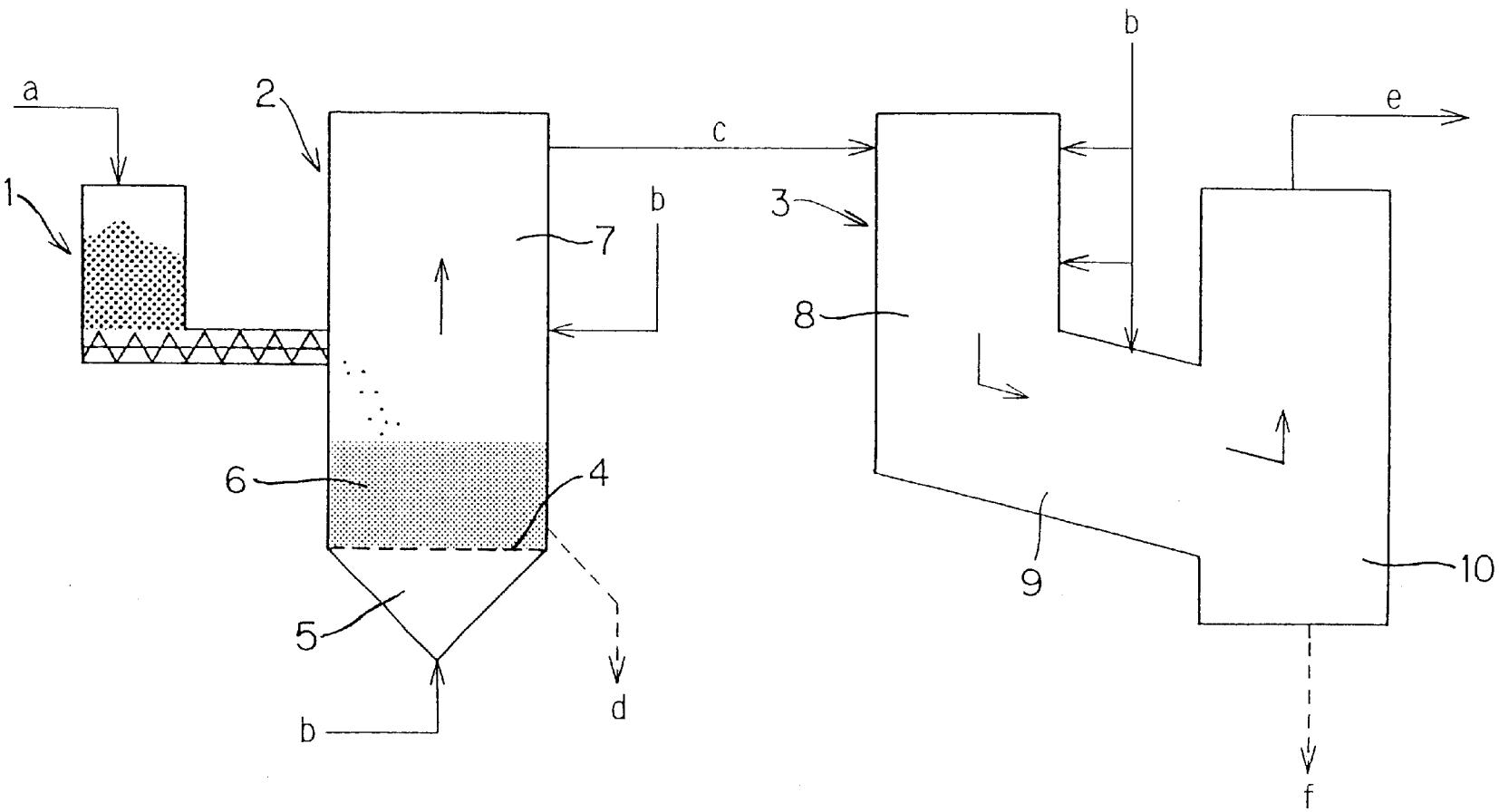
FIG. 6 is a schematic diagram showing an overall structure of a conventional gasification and slagging combustion system.

FIG. 5 is a cross-sectional view taken along line V—V of a gas introducing portion of the slagging combustion furnace shown in FIG. 4. As shown in FIG. 5, the produced gas "c" from the fluidized-bed gasification furnace is supplied into the primary combustion chamber 8 so as to be directed tangentially to an imaginary circle formed by the swirling flow and having a diameter slightly smaller than the inner diameter of the primary combustion chamber 8, and similarly the combustion air "b" is supplied from four ports located at equal intervals into the primary combustion chamber 8 so as to be directed tangentially to the same imaginary circle.

According to the present invention, with respect to a low-quality waste whose lower heating value is 2000 kcal/kg or lower, the amount of oxygen used up to the primary combustion chamber is in the range of 40 to 100%, preferably 80 to 99% of a theoretical oxygen demand to thereby raise temperature in the primary combustion chamber to a high value by as small an amount of oxygen as possible. Further, the amount of oxygen supplied to the secondary combustion chamber is in the range of 30 to 90%, preferably 30 to 50% of a theoretical oxygen demand to thereby perform complete combustion. Thus, inasmuch as the amount of oxygen supplied to the primary combustion chamber can be reduced to the minimum amount required for raising temperature in the primary combustion chamber to a high value, the wastes having a low heating value can be combusted without any auxiliary fuel. Further, since the amount of oxygen required only for melting ash is supplied to the primary combustion chamber, the volume of the primary combustion chamber can be reduced, and the quantity of heat loss therefrom can be reduced. Further, the lower limit of heating value for being combusted without any auxiliary fuel can be lowered to about 1500 kcal/kg according to the present invention.

As described above, according to the present invention, combustibles are partially oxidized at a high temperature and ash content is converted into molten slag, and the process from melting of ash content into slag to discharge of slag is performed in a reducing atmosphere. Therefore, vaporization of the heavy metals having a low boiling point into combustible gas can be accelerated, and hence the heavy metals having a low boiling point which remain in the molten slag can be reduced to the lower limit, and harmless slag from which the heavy metals are not eluted out can be obtained.

Further, according to the present invention, inasmuch as it is not necessary to complete combustion in the primary combustion chamber of the swirling-type slagging combustion furnace, and only the amount of oxygen required for obtaining the high temperature is supplied, the wastes having a low heating value can be combusted without any auxiliary fuel, and the volume of the primary combustion chamber can be reduced.

Industrial Applicability

The present invention relates to a method for combusting combustible wastes such as municipal wastes, plastic wastes, sewage sludges, or automobile wastes by a single slagging combustion furnace, or a combination of a gasification furnace and a slagging combustion furnace, without generating dioxins, and at the same time for recovering ash content in the combustible wastes as glassy slag from which heavy metals are not eluted out. The present invention can be applied for treatment of various wastes.

What is claimed is:

1. A method for treating combustible wastes by gasifying said combustible wastes in a gasification furnace and then combusting combustible material produced by gasification in a slagging combustion furnace with a reducing atmosphere to convert ash content into molten slag, characterized in that:

said combustible wastes are gasified in said gasification furnace to produce gas and fixed carbon, said produced gas accompanied by pulverized fixed carbon and discharged from said gasification furnace is supplied to said slagging combustion furnace, said produced gas and fixed carbon are partially oxidized at a high temperature to convert ash content into molten slag while keeping the atmosphere in a reducing condition, and said slag is discharged from said stagging combustion furnace in such a condition that an amount of heavy metals having a low boiling point is reduced; and the remaining combustible gas is then completely combusted at a temperature which is equal to or lower than a temperature of partial oxidization of said produced gas and fixed carbon.

2. A method according to claim 1, wherein said slagging combustion furnace comprises a swirling-type slagging combustion furnace.

3. A method according to claim 1, wherein a total amount of oxygen in oxygen-containing gas supplied for gasification of said combustible wastes in said gasification furnace and partial oxidization of said produced gas and fixed carbon in said slagging combustion furnace is in the range of 80 to 99% of a theoretical oxygen demand of said wastes, and an amount of oxygen in oxygen-containing gas supplied for complete combustion in said slagging combustion furnace is in the range of 30 to 50% of a theoretical oxygen demand.

4. A method according to claim 1, wherein partial oxidization of said produced gas and fixed carbon in said slagging combustion furnace is performed at a temperature ranging from 1200 to 1600° C., and complete combustion in said slagging combustion furnace is performed at a temperature ranging from 900 to 1100° C.

5. A method according to claim 1, wherein said gasification of said combustible wastes in said gasification furnace is performed at a temperature ranging from 450 to 850° C.

6. A method according to claim 1, wherein said gasification furnace comprises a fluidized-bed furnace.

* * * * *